US009580816B2

(12) United States Patent
Miyamoto et al.

(10) Patent No.: US 9,580,816 B2
(45) Date of Patent: Feb. 28, 2017

(54) APPARATUS FOR CONTINUOUS ELECTROLYTIC TREATMENT OF STEEL SHEET AND METHOD FOR PRODUCING SURFACE-TREATED STEEL SHEET USING THE SAME

(75) Inventors: Yuka Miyamoto, Kawasaki (JP); Takeshi Suzuki, Chiba (JP); Hisato Noro, Kawasaki (JP); Masao Inose, Kawasaki (JP); Hiroki Iwasa, Kawasaki (JP); Norihiko Nakamura, Chiyoda-ku (JP); Yoichi Tobiyama, Chiba (JP)

(73) Assignee: JFE Steel Corporation, Tokyo (JP)

( * ) Notice: Subject to any disclaimer, the term of this patent is extended or adjusted under 35 U.S.C. 154(b) by 433 days.

(21) Appl. No.: 13/819,500

(22) PCT Filed: Sep. 14, 2011

(86) PCT No.: PCT/JP2011/005161
§ 371 (c)(1),
(2), (4) Date: May 13, 2013

(87) PCT Pub. No.: WO2012/035763
PCT Pub. Date: Mar. 22, 2012

(65) Prior Publication Data

US 2013/0228467 A1 Sep. 5, 2013

(30) Foreign Application Priority Data

Sep. 15, 2010 (JP) ..... 2010-206513

(51) Int. Cl.
*C23C 28/02* (2006.01)
*C25D 17/12* (2006.01)
(Continued)

(52) U.S. Cl.
CPC ..... *C23C 28/02* (2013.01); *C25D 7/0614* (2013.01); *C25D 7/0642* (2013.01); *C25D 9/10* (2013.01); *C25D 17/12* (2013.01)

(58) Field of Classification Search
CPC ..... C25D 7/06; C25D 7/0614–7/0642; C25D 17/10; C25D 17/12; C25D 11/02; C25D 11/04
(Continued)

(56) References Cited

U.S. PATENT DOCUMENTS 3,718,547 A * 2/1973 Cooke et al. ..... 205/139
3,975,242 A * 8/1976 Matsuda et al. ..... 205/82
(Continued)

FOREIGN PATENT DOCUMENTS

JP 3006846 U 9/1994
JP 2009-155665 A 7/2009
JP 2010-007130 A 1/2010

OTHER PUBLICATIONS

International Search Report dated Nov. 15, 2011, application No. PCT/JP2011/005161.

*Primary Examiner* — Louis Rufo
(74) *Attorney, Agent, or Firm* — RatnerPrestia

(57) ABSTRACT

Provided are an apparatus for continuous electrolytic treatment of a steel sheet that is suitable for producing a surface-treated steel sheet and a method for producing the surface-treated steel sheet using the apparatus for continuous electrolytic treatment of a steel sheet. The apparatus includes N pairs of tabular electrodes having a length L and being arranged to respectively face two surfaces of a steel sheet. Each electrode includes n sections arranged in the longitudinal direction of the electrode and disposed on the surface of the electrode facing the steel sheet surface. Each section is constituted by a conductive portion including an electrode portion having a length T1 and a nonconductive portion
(Continued)

made by making an electrode portion having a length T2 nonconductive, where $n \times N \geq 10$, $0.96 \geq T2/(T1+T2) \geq 0.05$, and $0.9 \geq T1/L \geq 0.1$.

9 Claims, 2 Drawing Sheets

(51) Int. Cl.
*C25D 7/06* (2006.01)
*C25D 9/10* (2006.01)

(58) Field of Classification Search
USPC ..... 205/138–142, 152–156; 204/202, 290.1
See application file for complete search history.

(56) References Cited

U.S. PATENT DOCUMENTS

| | | | | | |
|---|---|---|---|---|---|
| 4,401,540 | A | * | 8/1983 | Tatum et al. | 204/196.36 |
| 4,484,996 | A | * | 11/1984 | Bongartz et al. | 204/288 |
| 4,828,653 | A | * | 5/1989 | Traini et al. | 205/96 |
| 5,156,730 | A | * | 10/1992 | Bhatt et al. | 205/118 |
| 6,024,846 | A | * | 2/2000 | Legoupil | 204/206 |
| 6,099,709 | A | * | 8/2000 | Tanahashi et al. | 205/50 |
| 2003/0034252 | A1 | * | 2/2003 | Forand | 205/138 |

* cited by examiner

APPARATUS FOR CONTINUOUS ELECTROLYTIC TREATMENT OF STEEL SHEET AND METHOD FOR PRODUCING SURFACE-TREATED STEEL SHEET USING THE SAME

CROSS REFERENCE TO RELATED APPLICATIONS

This application is the U.S. National Phase application of PCT International Application No. PCT/JP2011/005161, filed Sep. 14, 2011, and claims priority to Japanese Patent Application No. 2010-206513, filed Sep. 15, 2010, the disclosures of each application being incorporated herein by reference in their entireties for all purposes.

FIELD OF THE INVENTION

The present invention relates to an apparatus for continuous electrolytic treatment of a steel sheet that is suitable for producing a surface-treated steel sheet mainly used for containers such as cans after the surface of the steel sheet being coated (laminated) with a resin such as a plastic film, and particularly a surface-treated steel sheet that exhibits excellent adhesion to a coating resin in high-temperature, humid environments (hereafter, this adhesion is referred to as wet resin adhesion) and excellent corrosion resistance even in the cases where the coating resin has detached. The present invention also relates to a method for producing the surface-treated steel sheet using the apparatus for continuous electrolytic treatment of a steel sheet.

BACKGROUND OF THE INVENTION

Tin-plated steel sheets, electrolytic-chromate-treated steel sheets, which are referred to as tin-free steel sheets, and the like are used for various metal cans such as beverage cans, food cans, pail cans, and 18-liter cans. In particular, tin-free steel sheets are manufactured by electrolytic treatment of steel sheets in a plating bath containing hexavalent Cr and have the advantage of having excellent wet resin adhesion to resins such as paints.

In recent years, the regulations on the use of hexavalent Cr have been increasingly imposed worldwide in response to growing environmental awareness. Alternate materials to tin-free steel sheets which are manufactured using a plating bath containing hexavalent Cr have been anticipated.

Various metal cans have been manufactured conventionally by painting tin-free steel sheets or the like and forming the painted steel sheets into can bodies. In recent years, a method in which laminated steel sheets coated with resin films such as plastic films instead of paints are formed into can bodies has been widely used for the reduction of waste produced in the manufacture of cans. In such laminated steel sheets, resins need to strongly adhere to the steel sheets. In particular, since beverage or food cans are subjected to retort sterilization steps in some cases after the contents thereof are packed, laminated steel sheets used for the beverage or food cans need to have excellent wet resin adhesion such that no resin is peeled even in high-temperature, humid environments and excellent corrosion resistance such that the cans are prevented from being perforated by corrosion due to the contents of the cans even if the resin is partially detached by scratching or the like.

In response to these needs, the inventors of the present invention have shown in patent document 1 that it is possible to manufacture a surface-treated steel sheet, which has excellent wet resin adhesion and excellent corrosion resistance, without using Cr by forming a corrosion-resistant film that includes at least one layer selected from a Ni layer, a Sn layer, an Fe—Ni alloy layer, an Fe—Sn alloy layer, and an Fe—Ni—Sn alloy layer on at least one surface of a steel sheet; and then forming an adhesive film by performing a cathode electrolytic treatment in an aqueous solution containing ions containing Ti and ions containing at least one metal selected from Co, Fe, Ni, V, Cu, Mn, and Zn.

Patent Document

Patent document 1: Japanese Unexamined Patent Application Publication No. 2009-155665

SUMMARY OF THE INVENTION

According to the method for producing a surface-treated steel sheet described in patent document 1, excellent wet resin adhesion cannot always be achieved when lamination is performed under conditions in which the degree of biaxial orientation (BO value) of a resin film is high (for example, low-temperature conditions) so as to be suitable for an application in which a high impact resistance is needed for the resin film after the lamination.

The present invention aims to provide an apparatus for continuous electrolytic treatment of a steel sheet that is suitable for producing a surface-treated steel sheet, which has excellent corrosion resistance and excellent wet resin adhesion even when lamination is performed under conditions for the BO value of a resin film being high, without using Cr, and a method for producing the surface-treated steel sheet using the apparatus for continuous electrolytic treatment of a steel sheet.

The inventors of the present invention have conducted intensive studies and have found that, in the method for producing a surface-treated steel sheet disclosed in patent document 1, it is effective to use an apparatus for continuous electrolytic treatment of a steel sheet including an electrode including n sections arranged in the longitudinal direction of the electrode and disposed on the surface of the electrode facing the steel sheet, each section being constituted by a conductive portion including an electrode portion and a nonconductive portion made by making an electrode portion nonconductive.

The present invention has been made on the basis of the above-described findings and provides an apparatus for continuous electrolytic treatment of a steel sheet that includes N pairs of tabular electrodes having a length of L and being arranged to respectively face two surfaces of a steel sheet. Each electrode includes n sections arranged in the longitudinal direction of the electrode and disposed on the surface of the electrode facing the steel sheet. Each section is constituted by a conductive portion including an electrode portion having a length of T1 and a nonconductive portion made by making an electrode portion having a length of T2 nonconductive, where $n \times N \geq 10$, $0.96 \geq T2/(T1+T2) \geq 0.05$, and $0.9 \geq T1/L \geq 0.1$.

The nonconductive portion of the apparatus for continuous electrolytic treatment of a steel sheet according to the present invention preferably includes an electrode portion covered with an insulator having water resistance and acid resistance or an electrode portion with which a gap is provided.

The present invention also provides a method for producing a surface-treated steel sheet. In the method, a corrosion-resistant film that includes at least one layer selected from a Ni layer, a Sn layer, an Fe—Ni alloy layer, an Fe—Sn alloy layer, and an Fe—Ni—Sn alloy layer is formed on at least one surface of a steel sheet. An adhesive film is then formed by performing a cathode electrolytic treatment using the above apparatus for continuous electrolytic treatment of a steel sheet in an aqueous solution containing 0.008 to 0.07 mol/l (l: liter) of Ti and at least one metal element selected from Co, Fe, Ni, V, Cu, Mn, and Zn, where the total molar ratio of the at least one metal element is 0.01 to 10 relative to Ti.

The Ti content of the adhesive film is preferably 3 to 200 $mg/m^2$ per surface of the steel sheet.

The present invention also provides another method for producing a surface-treated steel sheet. In the method, a corrosion-resistant film that includes at least one layer selected from a Ni layer, a Sn layer, an Fe—Ni alloy layer, an Fe—Sn alloy layer, and an Fe—Ni—Sn alloy layer is formed on at least one surface of a steel sheet. An adhesive film is then formed by performing a cathode electrolytic treatment using the apparatus for continuous electrolytic treatment of a steel sheet in an aqueous solution containing 0.008 to 0.07 mol/l (l: liter) of Zr.

The aqueous solution preferably further contains at least one metal element selected from Co, Fe, Ni, V, Cu, Mn, and Zn, where the total molar ratio of the at least one metal element is 0.01 to 10 relative to Zr, or at least one substance selected from phosphoric acids and phenolic resins, where the total molar ratio of the at least one substance is 0.01 to 10 relative to Zr. Furthermore, the Zr content of the adhesive film is preferably 3 to 200 $mg/m^2$ per surface of the steel sheet.

The apparatus for continuous electrolytic treatment of a steel sheet according to the present invention may be used to manufacture a surface-treated steel sheet, which has excellent corrosion resistance and excellent wet resin adhesion even when lamination is performed under conditions for the BO value of a resin film being high, without using Cr. The surface-treated steel sheets according to the present invention can serve as an alternate material without problems to existing tin-free steel sheets and can be used for containers containing oil, organic solvents, paints or the like without resin coating. In addition, in the case when the surface-treated steel sheet is coated with a resin to form a resin-coated steel sheet and worked into cans and can lids, the resin is prevented from separation even exposed to a retort atmosphere, and elution of Fe, which is the base metal, is significantly small even at a portion where the resin has detached such as a scratched portion, thus the surface-treated steel sheet exhibiting excellent corrosion resistance.

DESCRIPTION OF EMBODIMENTS OF THE INVENTION

1) Apparatus for Continuous Electrolytic Treatment of Steel Sheet

Figure 1:
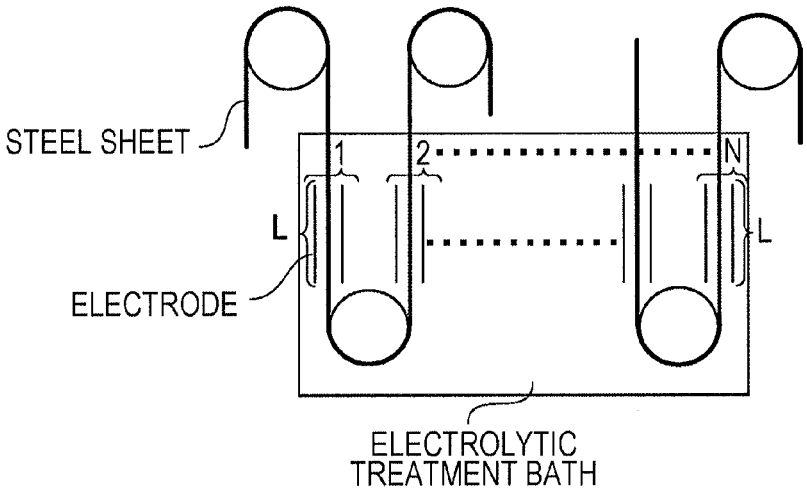
FIG. 1 is a diagram showing an example of an electrode arrangement in an electrolytic treatment bath of an apparatus for continuous electrolytic treatment of a steel sheet according to the present invention.
Figure 2:
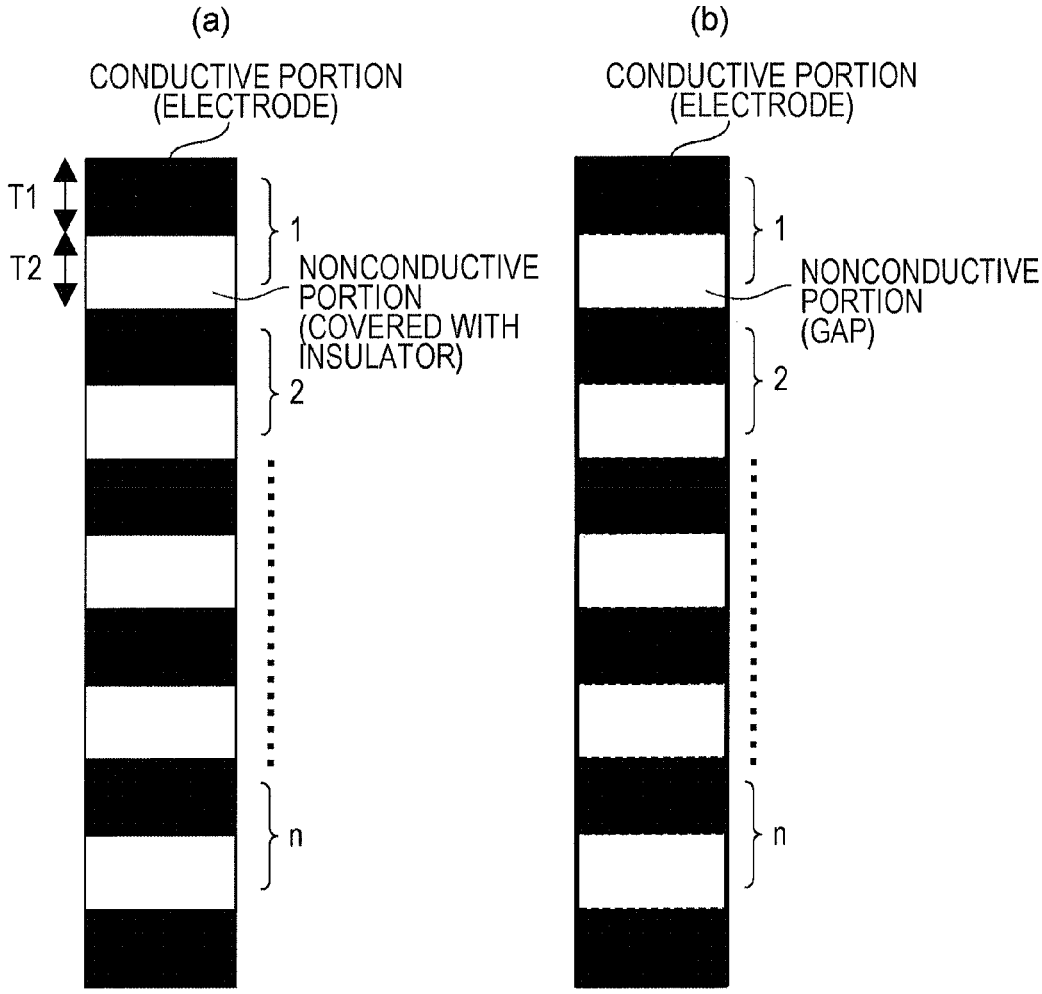
FIG. 2 is a diagram showing an example of electrodes used for the apparatus for continuous electrolytic treatment of a steel sheet according to the present invention.

FIG. 1 shows an example of an electrode arrangement in an electrolytic treatment bath of an apparatus for continuous electrolytic treatment of a steel sheet according to the present invention. The apparatus for continuous electrolytic treatment includes N pairs of tabular electrodes having a length of L and being arranged to respectively face two surfaces of a steel sheet. The electrodes, the total number of which is 2×N, each include, as shown in FIG. 2, n sections arranged in the longitudinal direction of the electrode. Each section is constituted by a conductive portion including an electrode portion having a length of T1 and a nonconductive portion made by making an electrode portion having a length of T2 nonconductive, where $n \times N \geq 10$, $0.96 \geq T2/(T1+T2) \geq 0.05$, and $0.9 \geq T1/L \geq 0.1$. Through a cathode electrolytic treatment using an apparatus for continuous electrolytic treatment including such electrodes satisfying the above relationships, a dense adhesive film having surface irregularities more uniformly distributed is formed and thereby excellent wet resin adhesion is achieved. In particular, in order to stably achieve excellent wet resin adhesion, $0.67 \geq T2/(T1+T2) \geq 0.33$ and $n \times N \geq 20$ are preferably satisfied.

Although the width of the nonconductive portions is preferably equal to the width of the electrodes, the effect of the present invention is not impaired as long as the width of the nonconductive portions is preferably 90% or more of the width of the electrodes. Preferably, all of the electrodes in the same apparatus for continuous electrolytic treatment of a steel sheet have the same T2/(T1+T2) and the same T1/L.

The nonconductive portions can be formed by covering the electrode portions with an insulator having high adhesion, water resistance, and acid resistance, such as Dunlop tape (No. 375) manufactured by Nitto Denko. Alternatively, the nonconductive portions can be formed by providing gaps with the electrodes.

2) Method for Producing Surface-Treated Steel Sheet

2-1) Formation of Corrosion-Resistant Film

A low-carbon cold-rolled steel sheet, which is commonly used for cans, is used as a raw material. A corrosion-resistant film that includes one or more layers selected from a Ni layer, a Sn layer, an Fe—Ni alloy layer, an Fe—Sn alloy layer, and an Fe—Ni—Sn alloy layer, and that strongly bonds to the base steel sheet is formed on the surface of the steel sheet to impart excellent corrosion resistance to the steel sheet even if a part of the resin has detached from the resulting resin-coated steel sheet due to scratching or the like.

When a Ni layer is used, the amount of Ni adhered to one surface of the steel sheet is preferably 200 $mg/m^2$ or more. When an Fe—Ni alloy layer is used, the amount of Ni adhered to one surface of the steel sheet is preferably 60 $mg/m^2$ or more. When a Sn layer or an Fe—Sn alloy layer is used, the amount of Sn adhered to one surface of the steel sheet is preferably 100 $mg/m^2$ or more. When an Fe—Ni—Sn alloy layer is used, the amount of Ni adhered to one surface of the steel sheet is preferably 50 $mg/m^2$ or more and the amount of Sn adhered to one surface of the steel sheet is preferably 100 $mg/m^2$ or more.

The above corrosion-resistant films can be formed by a publicly-known method depending on the metal element contained therein.

2) Formation of Adhesive Film

A cathode electrolytic treatment is performed in an aqueous solution containing 0.008 to 0.07 mol/l of Ti and at least one metal selected from Co, Fe, Ni, V, Cu, Mn, and Zn, where the total molar ratio of the at least one metal relative to Ti is 0.01 to 10 and thereby an adhesive film is formed on the corrosion-resistant film described above. When the cathode electrolytic treatment is performed using the apparatus for continuous electrolytic treatment of a steel sheet according to the present invention, excellent wet resin adhesion can be achieved even if lamination is performed under conditions for the BO value of a resin film being high. The reason is not exactly known, but it is considered that, when a cathode electrolytic treatment is performed in an aqueous solution containing such a concentration of Ti and at least one metal selected from Co, Fe, Ni, V, Cu, Mn, and Zn using the above-described electrodes, each including a plurality of sections arranged in the longitudinal direction of the electrode, each section including a conductive portion and a nonconductive portion, precipitation of Ti oxide at the conductive portions and dissolution of Ti oxide at the nonconductive portions repeatedly occur, which allows formation of a dense adhesive film having surface irregularities more uniformly distributed. The nonconductive portions disposed on the surfaces of the electrodes facing the steel sheet, which are described above, are ideally in a state in which no cathode electrolytic current flows, but practically, there may be a case in which a significantly weak current may unavoidably flow due to stray current or discharge characteristics of capacitors of a DC power supply. However, even if the extremely weak cathode electrolytic current flows in the nonconductive portion, the effect of the present invention can be achieved as long as dissolution of Ti oxide in the nonconductive portion is not blocked.

Preferred examples of an aqueous solution containing Ti include aqueous solutions containing fluorotitanate ions and aqueous solutions containing fluorotitanate ions and fluoride salts. Examples of compounds that can be used to produce fluorotitanate ions include fluorotitanic acid, ammonium fluorotitanate, and potassium fluorotitanate. Examples of the fluoride salts that can be used include sodium fluoride, potassium fluoride, silver fluoride, and tin fluoride. In particular, a method in which a steel sheet on which a corrosion-resistant film has been formed is subjected to a cathode electrolytic treatment in an aqueous solution containing potassium fluorotitanate or in an aqueous solution containing potassium fluorotitanate and sodium fluoride is preferable because a uniform film can be formed efficiently. The concentration of Ti needs to be 0.008 to 0.07 mol/l, and is more preferably 0.02 to 0.05 mol/1.

Examples of compounds that can be used to produce ions of Co, Fe, Ni, V, Cu, Mn, or Zn include cobalt sulfate, cobalt chloride, iron sulfate, iron chloride, nickel sulfate, copper sulfate, vanadium oxysulfate, zinc sulfate, manganese sulfate and the like. The total concentration of these metals needs to be 0.01 to 10, and is more preferably 0.1 to 2.5 in terms of molar ratio relative to Ti.

The Ti content of the adhesive film is preferably 3 to 200 $mg/m^2$ per surface of a steel sheet. This is because, when the Ti content is 3 $mg/m^2$ or more, excellent wet resin adhesion can be fully achieved, but if the Ti content is greater than 200 $mg/m^2$, the effect reaches saturation, which results in a high cost. The Ti content of the adhesive film can be controlled by changing the Ti concentration of an aqueous solution, current density, electric quantity, pH, or the like.

The total amount (M/Ti) of Co, Fe, Ni, V, Cu, Mn, and Zn contained in the adhesive film needs to be 0.01 to 10, and is preferably 0.1 to 2.5 in terms of mass ratio relative to Ti. This is because a dense adhesive film having surface irregularities which are more uniformly distributed can be formed and thereby excellent wet resin adhesion is achieved.

Excellent wet resin adhesion can also be achieved by forming an adhesive film by performing a cathode electrolytic treatment using the apparatus for continuous electrolytic treatment of a steel sheet according to the present invention, in an aqueous solution containing 0.008 to 0.07 mol/l (l: liter) and preferably 0.02 to 0.05 mol/l of Zr, in place of the above-described aqueous solution containing Ti. In addition, when Zr is used, there are advantages in that occurrence of streaky irregularities on the surface thereof is prevented with certainty and thereby a superior appearance can be achieved.

Preferred examples of an aqueous solution containing Zr include an aqueous solution containing fluorozirconate ions and an aqueous solution containing fluorozirconate ions and fluoride salts. Examples of compounds that can be used to produce fluorozirconate ions include fluorozirconic acid, ammonium hexafluorozirconate, and potassium hexafluorozirconate. Examples of the fluoride salts that can be used include sodium fluoride, potassium fluoride, silver fluoride, and tin fluoride. In particular, an aqueous solution containing potassium hexafluorozirconate and an aqueous solution containing potassium hexafluorozirconate and sodium fluoride are preferable, because these aqueous solutions allow efficient formation of a homogeneous adhesive film.

In order to form a denser adhesive film having surface irregularities which are more uniformly distributed, the aqueous solution preferably further contains at least one metal element selected from Co, Fe, Ni, V, Cu, Mn, and Zn, where the total molar ratio of the at least one metal element is preferably 0.01 to 10 and more preferably 0.1 to 2.5 relative to Zr. Moreover, in order to improve wet resin adhesion, the aqueous solution preferably further contains at least one substance selected from phosphoric acids and phenolic resins, where the total molar ratio of the at least one substance is 0.01 to 10 and more preferably 0.05 to 5 relative to Zr. The reason why wet resin adhesion is improved by containing a phosphoric acid or a phenolic resin is not clear at present. However, it is considered that cross-linking occurs by dehydration condensation between hydroxyl groups in an adhesive film and hydroxyl groups on the surface of metals such as a steel sheet or the like or between hydroxyl groups in phosphate groups and the hydroxyl groups on the surface of metals such as a steel sheet or the like, and thereby the surface of the metal and a Zr film bind covalently through oxygen atoms. In addition, when a phosphoric acid or a phenolic resin is contained, there is an advantage in that spotted rust, which is likely to occur in acidic environment, can be prevented with certainty.

Examples of compounds that can be used to produce ions of Co, Fe, Ni, V, Cu, Mn, or Zn include cobalt sulfate, cobalt chloride, iron sulfate, iron chloride, nickel sulfate, copper sulfate, vanadium oxysulfate, zinc sulfate, and manganese sulfate. Examples of compounds that can be used to produce phosphoric acids include orthophosphoric acid or phosphate compounds of metal ions that are added together. Examples of the phosphate compounds include nickel phosphate, iron phosphate, cobalt phosphate, and zirconium phosphate. The weight-average molecular weight of the phenolic resin is preferably about 3000 to 20000, and more preferably about 5000. The phenolic resin may be modified with amino alcohols so as to have water solubility.

The Zr content of an adhesive film is preferably 3 to 200 $mg/m^2$ per surface of a steel sheet. This is because, when the Zr content is 3 $mg/m^2$ or more, excellent wet resin adhesion can be achieved as an effect, but if the Zr content is greater than 200 mg/m$^2$, the effect reaches saturation, which results in a high cost. The Zr content of the adhesive film can be controlled by changing the Zr concentration of an aqueous solution, current density, electric quantity, pH, or the like.

The total amount (M/Zr) of Co, Fe, Ni, V, Cu, Mn, and Zn contained in the adhesive film needs to be 0.01 to 10 and preferably 0.05 to 3 in terms of mass ratio relative to Zr. In addition, the total amount (P/Zr+C/Zr) of P derived from phosphoric acids and C derived from phenolic resins need to be 0.01 to 10 in terms of mass ratio relative to Zr. This is because a denser adhesive film having surface irregularities which are more uniformly distributed can be formed and thereby excellent wet resin adhesion is achieved.

The adhesive film preferably further contains 0, because the adhesive film is mainly composed of a Zr oxide when 0 is contained, which is effective in improving wet resin adhesion.

The Ti, Zr, Co, Fe, Ni, V, Cu, Mn, and Zn contents in an adhesive film can be determined by performing surface analysis using X-ray fluorescence. The presence of O can be confirmed by surface analysis using XPS (X-ray photoelectron spectroscopy system), although the method for determining the O content is not particularly limited.

A laminated steel sheet can be manufactured by laminating a resin film on a surface-treated steel sheet that includes a corrosion-resistant film and an adhesive film formed by the above-described method according to the present invention. Since a surface-treated steel sheet manufactured by the method according to the present invention has excellent wet resin adhesion as described above, the laminated steel sheet has excellent corrosion resistance and formability.

Examples of the resin film laminated on the surface-treated steel sheet according to the present invention include, but are not limited to, films composed of various thermoplastic resins and thermosetting resins. Examples of such resin films that can be used include thermoplastic resin films such as olefin resin films composed of polyethylene, polypropylene, ethylene-propylene copolymers, ethylene-vinyl acetate copolymers, ethylene-acrylic ester copolymers, ionomers or the like; polyester films composed of polybutylene terephthalate or the like; polyamide films composed of nylon 6, nylon 6,6, nylon 11, nylon 12 or the like; polyvinyl chloride films; and polyvinylidene chloride films, which are unstretched or biaxially stretched. When an adhesive is used for lamination, the adhesive is preferably a urethane adhesive, an epoxy adhesive, an acid-modified olefin resin adhesive, a copolyamide adhesive, a copolyester adhesive or the like.

Thermoplastic or thermosetting paints such as modified epoxy paints including phenolic epoxy paints and amino-epoxy paints and the like; vinyl chloride-vinyl acetate copolymers; saponified vinyl chloride-vinyl acetate copolymers; vinyl chloride-vinyl acetate-maleic anhydride copolymers; epoxy-modified vinyl paints, epoxy amino-modified vinyl paints, and epoxy phenol-modified vinyl paints or modified vinyl paints; acrylic paints; synthetic rubber paints including styrene-butadiene copolymers, and the like can be used alone or in a combination of two or more.

The thickness of the resin laminating layer is preferably 3 to 50 μm. This is because, if the thickness is below the range, corrosion resistance is insufficient, and if the thickness is above the range, problems tend to occur in terms of formability.

The resin laminating layer on a surface-treated steel sheet can be formed by any method. Examples of the method include an extrusion-coating method, a cast film heat-bonding method, and a biaxially-stretched-film heat-bonding method.

Example 1

A corrosion-resistant film is formed on both surfaces of a low-carbon cold-rolled steel sheet (sheet thickness: 0.2 mm) as cold-rolled for use in producing tin-free steel sheets (TFS). The corrosion-resistant film is formed by using a plating bath a or b as shown in Table 1 by any one of the following plating methods A to D.

A: A cold-rolled steel sheet is annealed at about 700° C. in a 10 vol % $H_2$+90 vol % $N_2$ atmosphere, temper-rolled at an elongation of 1.5%, degreased by alkaline electrolysis, pickled with sulfuric acid, and plated with Ni using a plating bath a. Thus, a corrosion-resistant film composed of a Ni layer is formed.

B: A cold-rolled steel sheet is degreased by alkaline electrolysis, plated with Ni using a plating bath a, annealed at about 700° C. in a 10 vol % $H_2$+90 vol % $N_2$ atmosphere to diffuse Ni plating with penetration, and temper-rolled at an elongation of 1.5%. Thus, a corrosion-resistant film composed of an Fe—Ni alloy layer is formed.

C: A cold-rolled steel sheet is degreased by alkaline electrolysis, plated with Ni using a plating bath a, then annealed at about 700° C. in a 10 vol % $H_2$+90 vol % $N_2$ atmosphere to diffuse Ni plating with penetration, temper-rolled at an elongation of 1.5%, degreased, pickled, plated with Sn using a plating bath b, and subjected to heat-melting treatment by holding at a temperature equal to or higher than the melting point of Sn. Through the above process, a corrosion-resistant film composed of an Fe—Ni—Sn alloy layer and a Sn layer on the Fe—Ni—Sn alloy layer is formed.

D: A cold-rolled steel sheet is degreased by alkaline electrolysis, annealed and temper-rolled as in method A, plated with Sn using a plating bath b, and then subjected to heat-melting treatment in which heating and holding at a temperature equal to or higher than the melting point of Sn are performed. Through the above process, a corrosion-resistant film composed of an Fe—Sn alloy layer and a Sn layer on the Fe—Sn alloy layer is formed.

In the processes of C and D, a part of the Sn plating participates in alloying through the heat-melting treatment.

Subsequently, a cathode electrolytic treatment is performed on the corrosion-resistant films formed on both surfaces of the steel sheet under the conditions of cathode electrolytic treatment shown in Tables 2 to 4 using the apparatus for continuous electrolytic treatment shown in FIG. 1, which includes electrodes that are covered with Dunlop tape (No. 375) manufactured by Nitto Denko serving as an insulator so that T2 is 70 mm as shown in FIG. 2(*a*), or that include gaps so that T2 is 70 mm as shown in FIG. 2(*b*). The resulting steel sheet is dried, so that adhesive films containing Ti are formed. Thus, surface-treated steel sheets Nos. 1 to 25 are manufactured. The surface-treated steel sheets Nos. 6 and 16 are Comparative examples, since T2/(T1+T2) and T1/L are outside the scope of the present invention. The surface-treated steel sheets Nos. 10 and 13 are Comparative examples, since n×N, T2/(T1+T2), and T1/L are outside the scope of the present invention. The surface-treated steel sheet No. 22 is Comparative example, since n×N is outside the scope of the present invention.

The Ni and Sn contents of the corrosion-resistant film and the Ti content of the adhesive film are determined by an X-ray fluorescence analysis method with reference to calibration sheets having the composition determined by chemical analysis in advance. The Co and Fe contents are determined by any suitable method selected from the X-ray fluorescence analysis method as in the case of Ti, chemical analysis, Auger electron spectroscopy, and secondary ion mass spectrometry. The mass ratio (M/Ti) of Co, Fe or total of Co and Fe in the adhesive film relative to Ti is thereby evaluated. The presence of O in all steel sheets Nos. 1 to 25 can be confirmed by surface analysis using XPS.

Isophthalic acid copolymerized polyethylene terephthalate films having a draw ratio of 3.1×3.1, a thickness of 25 μm, a copolymerization ratio of 12 mol %, and a melting point of 224° C. are laminated on both surfaces of each of the surface-treated steel sheets Nos. 1 to 25 under the laminating conditions for the BO value of a resin film being 150 or 250, that is, a steel sheet feed rate: 40 m/min, a nip length of rubber roller: 17 mm, and a time lag between pressing and water cooling: 1 second. Thus, laminated steel sheets Nos. 1 to 25 are manufactured. The nip length is the length of a portion where the rubber roller comes into contact with a steel sheet in the feed direction. The BO value of a resin film is the intensity of X-ray diffraction of the PET (100) plane observed around 2θ=26° and determined using a Cu vacuum tube as an X-ray source. Wet resin adhesion and corrosion resistance of the manufactured laminated steel sheets Nos. 1 to 25 are evaluated by the following methods.

Figure 3:
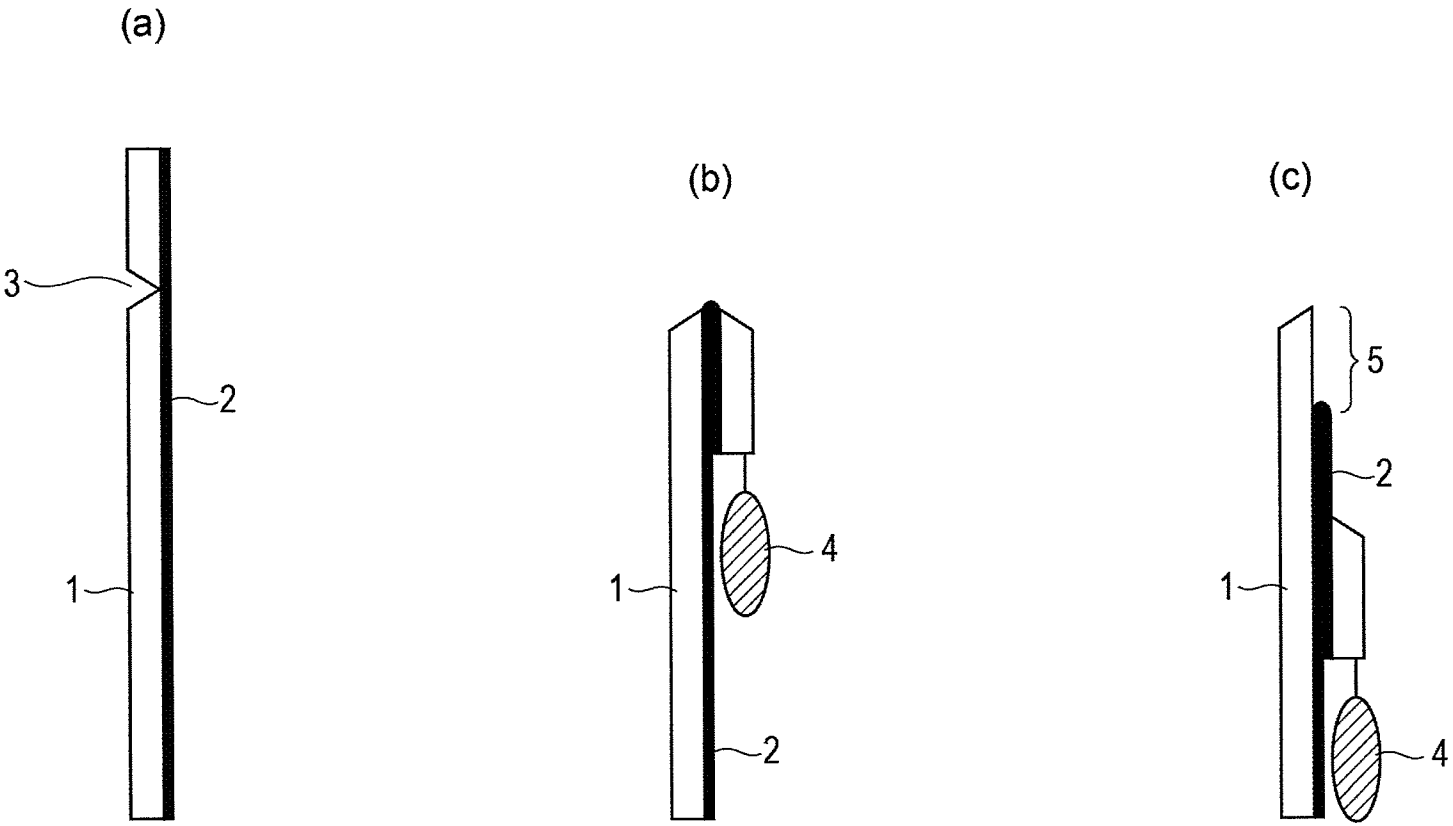
FIG. 3 is a diagram illustrating a 180° peel test.

Wet resin adhesion: Wet resin adhesion is evaluated by a 180° peel test in a retort atmosphere at a temperature of 130° C. and a relative humidity of 100%. The 180° peel test is a film-peeling test in which a test piece (size: 30 mm×100 mm, each of the surfaces is considered as n=1, so that each laminated steel sheet has n=2) that includes a steel sheet 1 from which a portion 3 has been cut so that a film 2 remains as shown in FIG. 3 (*a*) is used, a weight 4 (100 g) is attached to an end of the test piece, the test piece is bent 180° to the film 2 side as shown in FIG. 3 (*b*), and the test piece is left standing for 30 minutes. A peel length 5 shown in FIG. 3 (*c*) is measured and evaluated. The peel lengths of both surfaces (n=2) of each laminated steel sheet are averaged. While a smaller peel length 5 indicates better wet resin adhesion, test pieces are evaluated as having excellent wet resin adhesion targeted in the present invention when the peel length 5 is less than 10 mm at a BO value of 150, and when the peel length 5 is less than 20 mm at a BO value of 250.

Corrosion resistance: Cuts intersecting each other and reaching the base material are formed in the laminated surfaces of the laminated steel sheet with a cutter. The resulting laminated steel sheet is immersed in 80 ml of a test solution containing equal amounts of a 1.5 mass % NaCl aqueous solution and a 1.5 mass citric acid aqueous solution, and left for 9 days at a temperature of 55° C. The corrosion resistance (each of the surfaces is considered as n=1, so that each laminated steel sheet has n=2) of the cut portion is evaluated as below. The term "A" refers to good corrosion resistance.

A: Corrosion is not present in both of n=2

F: Corrosion is present in one or more of the n=2

The results are shown in Table 5. The laminated steel sheets Nos. 1 to 5, 7 to 9, 11, 12, 14, 15, 17 to 21, and 23 to 25, which are Examples of the present invention, each exhibits excellent wet resin adhesion and corrosion resistance. In contrast, the laminated steel sheets Nos. 6, 10, 13, 16, 22, and 26, which are Comparative examples, have poor wet resin adhesion when the BO value is 250, although having excellent wet resin adhesion and corrosion resistance when the BO value is 150.

TABLE 1

| Plating bath | Bath composition |
|---|---|
| a (Ni-plating bath) | Nickel sulfate: 250 g/l,<br>nickel chloride: 45 g/l, and<br>boric acid: 30 g/l |
| b (Sn-plating bath) | Stannous sulfate: 55 g/l,<br>phenolsulfonic acid (65 mass %): 35 g/l, and<br>brightener: appropriate amount |

TABLE 2

| Surface-treated steel sheet No. | Plating treatment Plating method | Cathode electrolytic treatment Electrode Nonconductive portion | n × N | T2/(T1 + T2) | T1/L | Treatment bath composition | Current density (A/dm$^2$) |
|---|---|---|---|---|---|---|---|
| 1 | A | Covered with insulator | 13 | 0.67 | 0.33 | Potassium fluorotitanate 10.6 g/l + cobalt sulfate heptahydrate 5 g/l | 6 |
| 2 | A | Covered with insulator | 20 | 0.50 | 0.50 | Potassium fluorotitanate 10.6 g/l + cobalt sulfate heptahydrate 5 g/l | 7 |
| 3 | A | Covered with insulator | 25 | 0.40 | 0.60 | Potassium fluorotitanate 10.6 g/l + cobalt sulfate heptahydrate 5 g/l | 6 |
| 4 | A | Covered with insulator | 40 | 0.50 | 0.50 | Potassium fluorotitanate 10.6 g/l + cobalt sulfate heptahydrate 5 g/l | 8 |
| 5 | A | Covered with insulator | 80 | 0.40 | 0.60 | Potassium fluorotitanate 10.6 g/l + cobalt sulfate heptahydrate 5 g/l | 7 |
| 6 | A | Covered with insulator | 10 | 0.98 | 0.02 | Potassium fluorotitanate 10.6 g/l + cobalt sulfate heptahydrate 5 g/l | 7 |
| 7 | A | Covered with insulator | 25 | 0.50 | 0.50 | Potassium fluorotitanate 10.6 g/l + iron sulfate heptahydrate 5 g/l + cobalt sulfate heptahydrate 4 g/l | 6 |
| 8 | A | Gap | 20 | 0.33 | 0.67 | Potassium fluorotitanate 10.6 g/l + iron sulfate heptahydrate 5 g/l + cobalt sulfate heptahydrate 4 g/l | 6 |
| 9 | A | Gap | 40 | 0.50 | 0.50 | Potassium fluorotitanate 10.6 g/l + iron sulfate heptahydrate 5 g/l | 6 |

TABLE 2-continued

| | | | | | | | |
|---|---|---|---|---|---|---|---|
| 10 | A | Gap | 4 | 0.03 | 0.97 | Potassium fluorotitanate 10.6 g/l + iron sulfate heptahydrate 5 g/l + cobalt sulfate heptahydrate 4 g/l | 6 |

| Surface-treated steel sheet No. | Amounts of Ni and Sn in corrosion-resistant film (mg/m$^2$) Ni | Sn | Adhesive film Amount of Ti (mg/m$^2$) | Added element | M/Ti (mass ratio) | Remarks |
|---|---|---|---|---|---|---|
| 1 | 295 | 0 | 60 | Co | 0.95 | Example |
| 2 | 295 | 0 | 30 | Co | 0.81 | Example |
| 3 | 295 | 0 | 60 | Co | 0.95 | Example |
| 4 | 295 | 0 | 100 | Co | 0.49 | Example |
| 5 | 295 | 0 | 10 | Co | 1.62 | Example |
| 6 | 295 | 0 | 10 | Co | 0.95 | Comparative example |
| 7 | 295 | 0 | 10 | Fe, Co | 1.67 | Example |
| 8 | 295 | 0 | 60 | Fe, Co | 1.11 | Example |
| 9 | 295 | 0 | 30 | Fe | 0.86 | Example |
| 10 | 295 | 0 | 60 | Fe, Co | 0.83 | Comparative example |

TABLE 3

| Surface-treated steel sheet No. | Plating treatment: Plating method | Cathode electrolytic treatment: Electrode: Nonconductive portion | n × N | T2/(T1 + T2) | T1/L | Treatment bath composition | Current density (A/dm$^2$) |
|---|---|---|---|---|---|---|---|
| 11 | B | Covered with insulator | 30 | 0.50 | 0.50 | Potassium fluorotitanate 10.6 g/l + cobalt sulfate heptahydrate 5 g/l | 7 |
| 12 | B | Covered with insulator | 30 | 0.38 | 0.62 | Potassium fluorotitanate 10.6 g/l + iron sulfate heptahydrate 5 g/l + cobalt sulfate heptahydrate 4 g/l | 8 |
| 13 | B | Covered with insulator | 4 | 0.97 | 0.03 | Potassium fluorotitanate 10.6 g/l + iron sulfate heptahydrate 5 g/l + cobalt sulfate heptahydrate 4 g/l | 7 |
| 14 | C | Covered with insulator | 30 | 0.41 | 0.59 | Potassium fluorotitanate 10.6 g/l + cobalt sulfate heptahydrate 5 g/l | 7 |
| 15 | C | Gap | 30 | 0.33 | 0.67 | Potassium fluorotitanate 10.6 g/l + iron sulfate heptahydrate 5 g/l + cobalt sulfate heptahydrate 4 g/l, | 8 |
| 16 | C | Gap | 15 | 0.02 | 0.98 | Potassium fluorotitanate 10.6 g/l + iron sulfate heptahydrate 5 g/l + cobalt sulfate heptahydrate 4 g/l | 7 |

| Surface-treated steel sheet No. | Amounts of Ni and Sn in corrosion-resistant film (mg/m$^2$) Ni | Sn | Adhesive film Amount of Ti (mg/m$^2$) | Added element | M/Ti (mass ratio) | Remarks |
|---|---|---|---|---|---|---|
| 11 | 80 | 0 | 60 | Co | 0.95 | Example |
| 12 | 80 | 0 | 60 | Fe, Co | 1.11 | Example |
| 13 | 80 | 0 | 10 | Fe, Co | 1.11 | Comparative example |
| 14 | 80 | 150 | 40 | Co | 1.22 | Example |
| 15 | 80 | 300 | 30 | Fe, Co | 1.94 | Example |
| 16 | 80 | 300 | 30 | Fe, Co | 1.94 | Comparative example |

TABLE 4

| Surface-treated steel sheet No. | Plating treatment: Plating method | Cathode electrolytic treatment: Electrode: Nonconductive portion | n × N | T2/(T1 + T2) | T1/L | Treatment bath composition | Current density (A/dm$^2$) |
|---|---|---|---|---|---|---|---|
| 17 | D | Covered with insulator | 13 | 0.67 | 0.33 | Potassium fluorotitanate 10.6 g/l + cobalt sulfate heptahydrate 5 g/l | 6 |
| 18 | D | Covered with insulator | 20 | 0.50 | 0.50 | Potassium fluorotitanate 10.6 g/l + cobalt sulfate heptahydrate 5 g/l | 7 |
| 19 | D | Covered with insulator | 25 | 0.47 | 0.53 | Potassium fluorotitanate 10.6 g/l + cobalt sulfate heptahydrate 5 g/l | 6 |
| 20 | D | Covered with insulator | 40 | 0.50 | 0.50 | Potassium fluorotitanate 10.6 g/l + cobalt sulfate heptahydrate 5 g/l | 8 |
| 21 | D | Covered with insulator | 80 | 0.33 | 0.67 | Potassium fluorotitanate 10.6 g/l + cobalt sulfate heptahydrate 5 g/l | 7 |
| 22 | D | Covered with insulator | 4 | 0.44 | 0.56 | Potassium fluorotitanate 10.6 g/l + cobalt sulfate heptahydrate 5 g/l + | 7 |
| 23 | D | Covered with insulator | 25 | 0.44 | 0.56 | Potassium fluorotitanate 10.6 g/l + iron sulfate heptahydrate 5 g/l + cobalt sulfate heptahydrate 4 g/l | 6 |
| 24 | D | Gap | 40 | 0.29 | 0.79 | Potassium fluorotitanate 10.6 g/l + iron sulfate heptahydrate 5 g/l + cobalt sulfate heptahydrate 4 g/l | 6 |
| 25 | D | Gap | 20 | 0.15 | 0.85 | Potassium fluorotitanate 10.6 g/l + cobalt sulfate heptahydrate 5 g/l | 6 |

| Surface-treated steel sheet No. | Amounts of Ni and Sn in corrosion-resistant film (mg/m$^2$): Ni | Sn | Adhesive film: Amount of Ti (mg/m$^2$) | Added element | M/Ti (mass ratio) | Remarks |
|---|---|---|---|---|---|---|
| 17 | 0 | 500 | 60 | Co | 1.08 | Example |
| 18 | 0 | 500 | 30 | Co | 1.90 | Example |
| 19 | 0 | 500 | 60 | Co | 0.95 | Example |
| 20 | 0 | 500 | 100 | Co | 0.50 | Example |
| 21 | 0 | 300 | 10 | Co | 2.44 | Example |
| 22 | 0 | 800 | 60 | Co | 0.54 | Comparative example |
| 23 | 0 | 800 | 10 | Fe, Co | 2.08 | Example |
| 24 | 0 | 500 | 60 | Fe, Co | 0.83 | Example |
| 25 | 0 | 800 | 30 | Fe | 0.86 | Example |

TABLE 5

| Laminated steel sheet No. | Wet resin adhesion: strip length (mm): BO 150 | BO 250 | Corrosion resistance | Remarks |
|---|---|---|---|---|
| 1 | 7 | 19 | A | Example |
| 2 | 5 | 18 | A | Example |
| 3 | 6 | 9 | A | Example |
| 4 | 7 | 15 | A | Example |
| 5 | 8 | 15 | A | Example |
| 6 | 9 | 40 | A | Comparative example |
| 7 | 7 | 18 | A | Example |
| 8 | 8 | 13 | A | Example |
| 9 | 9 | 8 | A | Example |
| 10 | 9 | 40 | A | Comparative example |
| 11 | 8 | 15 | A | Example |
| 12 | 9 | 14 | A | Example |
| 13 | 9 | 40 | A | Comparative example |
| 14 | 7 | 18 | A | Example |
| 15 | 9 | 15 | A | Example |
| 16 | 9 | 40 | A | Comparative example |

TABLE 5-continued

| Laminated steel sheet No. | Wet resin adhesion: strip length (mm): BO 150 | BO 250 | Corrosion resistance | Remarks |
|---|---|---|---|---|
| 17 | 6 | 19 | A | Example |
| 18 | 7 | 15 | A | Example |
| 19 | 6 | 10 | A | Example |
| 20 | 8 | 16 | A | Example |
| 21 | 9 | 17 | A | Example |
| 22 | 9 | 40 | A | Comparative example |
| 23 | 9 | 13 | A | Example |
| 24 | 8 | 9 | A | Example |
| 25 | 7 | 9 | A | Example |

Example 2

A cathode electrolytic treatment is performed on the corrosion-resistant films manufactured as in Example 1, under the conditions of cathode electrolytic treatment shown in Tables 6 to 8 using the apparatus for continuous electrolytic treatment shown in FIG. 1, which includes electrodes that are covered with Dunlop tape (No. 375) manufactured by Nitto Denko serving as an insulator so that T2 is 70 mm as shown in FIG. 2(*a*), or that include gaps so that T2 is 70 mm as shown in FIG. 2(*b*). Then drying is performed, so that an adhesive films containing Zr are formed. Thus, surface-treated steel sheets Nos. 1 to 24 are manufactured. The surface-treated steel sheets Nos. 3, 7, 15, 18, and 22 are Comparative examples, since T2/(T1+T2) and T1/L are outside the scope of the present invention. The surface-treated steel sheets Nos. 9, 12, and 24 are Comparative examples, since n×N, T2/(T1+T2), and T1/L are outside the scope of the present invention. A phenolic resin having a weight-average molecular weight of 5000 is used as a phenolic resin in the treatment bath.

The Ni and Sn contents of the corrosion-resistant film and the Zr content of the adhesive film are determined by the X-ray fluorescence analysis method with reference to calibration sheets having the composition chemically analyzed in advance. The Co, Fe, and P contents are determined by any one method appropriately selected from the X-ray fluorescence analysis method as in the case of Zr, chemical analysis, Auger electron spectroscopy, and secondary ion mass spectrometry. Then, the total mass ratio of Co and Fe (M/Zr) and the mass ratio of P (P/Zr) in the adhesive film relative to Zr are evaluated. The C content of the adhesive film is determined by subtracting the amount of C contained in a steel sheet as a background from the total amount of C determined by gas chromatography. Then, the mass ratio of C (C/Zr) relative to Zr is evaluated. The presence of O on steel sheets Nos. 1 to 24 can be confirmed by surface analysis using XPS.

Laminated steel sheets Nos. 1 to 24 are manufactured as in Example 1 using the surface-treated steel sheets Nos. 1 to 24 under the laminating condition for the BO value of a resin film being 150. Wet resin adhesion and corrosion resistance are examined as in Example 1.

The results are shown in Table 9. The laminated steel sheets Nos. 1, 2, 4 to 7, 8, 10, 11, 13, 14, 16, 17, 19 to 21, and 23, which are Examples of the present invention, each exhibit more excellent wet resin adhesion than the laminated steel sheets Nos. 3, 7, 9, 12, 15, 18, 22, and 24, which are Comparative examples. All of Examples and Comparative examples exhibit excellent corrosion resistance.

In sum, excellent wet resin adhesion and corrosion resistance can be achieved by using an apparatus for continuous electrolytic treatment of a steel sheet according to the present invention, even if an adhesive film contains Zr. When an adhesive layer contains Zr, as described above, there are advantages in that occurrence of streaky irregularities and spotted rust on the surface thereof can be suppressed with certainty. Therefore, an adhesive film containing Zr is very effective in applications where requirements against occurrence of streaky irregularities and spotted rust are stringent.

TABLE 6

| Surface-treated steel sheet No. | Plating treatment Plating method | Cathode electrolytic treatment: Electrode: Nonconductive portion | n × N | T2/(T1 + T2) | T1/L | Treatment bath composition | Current density (A/dm$^2$) |
|---|---|---|---|---|---|---|---|
| 1 | A | Covered with insulator | 25 | 0.50 | 0.50 | Potassium hexafluorozirconate 12.5 g/l + cobalt sulfate heptahydrate 5 g/l | 7 |
| 2 | A | Covered with insulator | 40 | 0.50 | 0.50 | Potassium hexafluorozirconate 12.5 g/l + cobalt sulfate heptahydrate 5 g/l | 7 |
| 3 | A | Covered with insulator | 10 | 0.98 | 0.02 | Potassium hexafluorozirconate 12.5 g/l + cobalt sulfate heptahydrate 5 g/l | 7 |
| 4 | A | Covered with insulator | 25 | 0.50 | 0.50 | Potassium hexafluorozirconate 4.5 g/l + orthophosphoric acid 1 g/l | 9 |
| 5 | A | Covered with insulator | 25 | 0.50 | 0.50 | Potassium hexafluorozirconate 4.5 g/l + orthophosphoric acid 1 g/l + phenolic resin 0.9 g/l | 3 |
| 6 | A | Covered with insulator | 25 | 0.50 | 0.50 | Potassium hexafluorozirconate 4.5 g/l + orthophosphoric acid 1 g/l + phenolic resin 0.9 g/l + cobalt sulfate 5 g/l | 3 |
| 7 | A | Covered with insulator | 10 | 0.98 | 0.02 | Potassium hexafluorozirconate 6.2 g/l + orthophosphoric acid 1 g/l + phenolic resin 0.9 g/l | 3 |
| 8 | A | Covered with insulator | 25 | 0.50 | 0.50 | Potassium hexafluorozirconate 6.2 g/l + orthophosphoric acid 1 g/l + phenolic resin 0.9 g/l + iron sulfate heptahydrate 5 g/l + cobalt sulfate heptahydrate 4 g/l | 1 |
| 9 | A | Covered with insulator | 4 | 0.03 | 0.97 | Potassium hexafluorozirconate 6.2 g/l + orthophosphoric acid 1 g/l + phenolic resin 0.9 g/l + iron sulfate heptahydrate 5 g/l + cobalt sulfate heptahydrate 4 g/l | 1 |

TABLE 6-continued

| Surface-treated steel sheet No. | Amounts of Ni and Sn in corrosion-resistant film ($mg/m^2$) Ni | Sn | Adhesive film: Amount of Zr ($mg/m^2$) | Added element | M/Zr (mass ratio) | P/Zr (mass ratio) | C/Zr (mass ratio) | Remarks |
|---|---|---|---|---|---|---|---|---|
| 1 | 295 | 0 | 30 | Co | 1.00 | — | — | Example |
| 2 | 295 | 0 | 60 | Co | 1.00 | — | — | Example |
| 3 | 295 | 0 | 10 | Co | 1.17 | — | — | Comparative example |
| 4 | 295 | 0 | 30 | — | — | 0.17 | — | Example |
| 5 | 295 | 0 | 10 | — | — | 0.30 | 0.38 | Example |
| 6 | 295 | 0 | 10 | Co | 3.00 | 0.30 | 0.38 | Example |
| 7 | 295 | 0 | 10 | — | — | 0.30 | 0.38 | Comparative example |
| 8 | 295 | 0 | 8 | Fe, Co | 4.00 | 0.38 | 0.48 | Example |
| 9 | 295 | 0 | 8 | Fe, Co | 3.00 | 0.38 | 0.48 | Comparative Example |

TABLE 7

| Surface-treated steel sheet No. | Plating treatment: Plating method | Cathode electrolytic treatment: Electrode: Nonconductive portion | n × N | T2/(T1 + T2) | T1/L | Treatment bath composition | Current density ($A/dm^2$) |
|---|---|---|---|---|---|---|---|
| 10 | B | Covered with insulator | 30 | 0.50 | 0.50 | Potassium hexafluorozirconate 12.5 g/l + cobalt sulfate heptahydrate 5 g/l + iron sulfate heptahydrate 5 g/l | 7 |
| 11 | B | Covered with insulator | 30 | 0.38 | 0.62 | Potassium hexafluorozirconate 12.5 g/l + orthophosphoric acid 1 g/l + phenolic resin 0.9 g/l | 1 |
| 12 | B | Covered with insulator | 4 | 0.97 | 0.03 | Potassium hexafluorozirconate 12.5 g/l + orthophosphoric acid 1 g/l + phenolic resin 0.9 g/l | 1 |
| 13 | C | Covered with insulator | 30 | 0.41 | 0.59 | Potassium hexafluorozirconate 12.5 g/l + cobalt sulfate heptahydrate 5 g/l | 5 |
| 14 | C | Gap | 30 | 0.33 | 0.67 | Potassium hexafluorozirconate 12.5 g/l + orthophosphoric acid 1 g/l + phenolic resin 0.9 g/l + cobalt sulfate 5 g/l | 1 |
| 15 | C | Gap | 15 | 0.02 | 0.98 | Potassium hexafluorozirconate 12.5 g/l + orthophosphoric acid 1 g/l + phenolic resin 0.9 g/l + cobalt sulfate 5 g/l | 1 |

| Surface-treated steel sheet No. | Amounts of Ni and Sn in corrosion-resistant film ($mg/m^2$) Ni | Sn | Adhesive film: Amount of Zr ($mg/m^2$) | Added element | M/Zr (mass ratio) | P/Zr (mass ratio) | C/Zr (mass ratio) | Remarks |
|---|---|---|---|---|---|---|---|---|
| 10 | 80 | 0 | 30 | Fe, Co | 1.67 | — | — | Example |
| 11 | 80 | 0 | 8 | — | — | 0.5 | 0.63 | Example |
| 12 | 80 | 0 | 8 | — | — | 0.5 | 0.63 | Comparative example |
| 13 | 80 | 150 | 30 | Co | 1.67 | — | — | Example |
| 14 | 80 | 700 | 8 | Co | 3.00 | 0.5 | 0.63 | Example |
| 15 | 80 | 700 | 8 | Co | 3.00 | 0.5 | 0.63 | Comparative example |

TABLE 8

| Surface-treated steel sheet No. | Plating treatment: Plating method | Cathode electrolytic treatment: Electrode: Nonconductive portion | n × N | T2/(T1 + T2) | T1/L | Treatment bath composition | Current density (A/dm$^2$) |
|---|---|---|---|---|---|---|---|
| 16 | D | Covered with insulator | 25 | 0.50 | 0.50 | Potassium hexafluorozirconate 12.5 g/l + cobalt sulfate heptahydrate 5 g/l | 3 |
| 17 | D | Covered with insulator | 40 | 0.50 | 0.50 | Potassium hexafluorozirconate 12.5 g/l + cobalt sulfate heptahydrate 5 g/l | 5 |
| 18 | D | Covered with insulator | 10 | 0.98 | 0.02 | Potassium hexafluorozirconate 12.5 g/l + cobalt sulfate heptahydrate 5 g/l | 6 |
| 19 | D | Covered with insulator | 25 | 0.50 | 0.50 | Potassium hexafluorozirconate 4.5 g/l + orthophosphoric acid 1 g/l | 5 |
| 20 | D | Covered with insulator | 25 | 0.50 | 0.50 | Potassium hexafluorozirconate 4.5 g/l + orthophosphoric acid 1 g/l + phenolic resin 0.9 g/l | 3 |
| 21 | D | Covered with insulator | 25 | 0.50 | 0.50 | Potassium hexafluorozirconate 4.5 g/l + orthophosphoric acid 1 g/l + phenolic resin 0.9 g/l + cobalt sulfate 5 g/l | 3 |
| 22 | D | Covered with insulator | 10 | 0.98 | 0.02 | Potassium hexafluorozirconate 6.2 g/l + orthophosphoric acid 1 g/l + phenolic resin 0.9 g/l | 3 |
| 23 | D | Gap | 25 | 0.50 | 0.50 | Potassium hexafluorozirconate 6.2 g/l + orthophosphoric acid 1 g/l + phenolic resin 0.9 g/l | 2 |
| 24 | D | Gap | 4 | 0.03 | 0.97 | Potassium hexafluorozirconate 6.2 g/l + orthophosphoric acid 1 g/l + phenolic resin 0.9 g/l | 2 |

| Surface-treated steel sheet No. | Amounts of Ni and Sn in corrosion-resistant film (mg/m$^2$): Ni | Sn | Adhesive film: Amount of Zr (mg/m$^2$) | Added element | M/Zr (mass ratio) | P/Zr (mass ratio) | C/Zr (mass ratio) | Remarks |
|---|---|---|---|---|---|---|---|---|
| 16 | 0 | 500 | 30 | Co | 1.00 | — | — | Example |
| 17 | 0 | 500 | 60 | Co | 1.00 | — | — | Example |
| 18 | 0 | 300 | 10 | Co | 1.17 | — | — | Comparative example |
| 19 | 0 | 800 | 30 | — | — | 0.17 | | Example |
| 20 | 0 | 800 | 10 | — | — | 0.30 | 0.38 | Example |
| 21 | 0 | 500 | 10 | Co | 3.00 | 0.30 | 0.38 | Example |
| 22 | 0 | 800 | 10 | — | — | 0.30 | 0.38 | Comparative example |
| 23 | 0 | 500 | 8 | — | — | 0.50 | 0.48 | Example |
| 24 | 0 | 500 | 8 | — | — | 0.50 | 0.48 | Comparative example |

TABLE 9

| Laminated steel sheet No. | Wet resin adhesion: strip length (mm) BO 150 | Corrosion resistance | Remarks |
|---|---|---|---|
| 1 | 13 | A | Example |
| 2 | 13 | A | Example |
| 3 | 19 | A | Comparative example |
| 4 | 13 | A | Example |
| 5 | 13 | A | Example |
| 6 | 13 | A | Example |
| 7 | 19 | A | Comparative example |
| 8 | 13 | A | Example |
| 9 | 19 | A | Comparative example |
| 10 | 13 | A | Example |
| 11 | 14 | A | Example |
| 12 | 19 | A | Comparative example |

TABLE 9-continued

| Laminated steel sheet No. | Wet resin adhesion: strip length (mm) BO 150 | Corrosion resistance | Remarks |
|---|---|---|---|
| 13 | 14 | A | Example |
| 14 | 14 | A | Example |
| 15 | 19 | A | Comparative example |
| 16 | 13 | A | Example |
| 17 | 13 | A | Example |
| 18 | 19 | A | Comparative example |
| 19 | 14 | A | Example |
| 20 | 14 | A | Example |
| 21 | 13 | A | Example |
| 22 | 19 | A | Comparative example |

TABLE 9-continued

| Laminated steel sheet No. | Wet resin adhesion: strip length (mm) BO 150 | Corrosion resistance | Remarks |
|---|---|---|---|
| 23 | 13 | A | Example |
| 24 | 19 | A | Comparative example |

REFERENCE SIGNS LIST

1 steel sheet
2 film
3 cut portion of a steel sheet
4 weight
5 peel length

The invention claimed is:

1. An apparatus for continuous electrolytic treatment of a steel sheet, the apparatus comprising N pairs of tabular electrodes having a length L being arranged to respectively face two surfaces of a steel sheet, each electrode including n sections arranged in the longitudinal direction of the electrode and disposed on the surface of the electrode facing the steel sheet surface, each section being constituted by a conductive portion including an electrode portion having a length T1 and a nonconductive portion made by making an electrode portion having a length T2 nonconductive, wherein $n \times N \geq 10$, $0.96 \geq T2/(T1+T2) \geq 0.05$, and $0.9 \geq T1/L \geq 0.1$, wherein the nonconductive portion is arranged between conductive portions of the electrode in the longitudinal direction of the electrode, wherein the nonconductive portion includes an electrode portion extending in the longitudinal direction of the electrode that is covered with an insulator having water resistance and acid resistance.

2. A method for producing a surface-treated steel sheet, the method comprising forming a corrosion-resistant film that includes at least one layer selected from a Ni layer, a Sn layer, an Fe—Ni alloy layer, an Fe—Sn alloy layer, and an Fe—Ni—Sn alloy layer on at least one surface of a steel sheet; and then forming an adhesive film by performing a cathode electrolytic treatment using the apparatus for continuous electrolytic treatment of a steel sheet according to claim 1, in an aqueous solution containing 0.008 to 0.07 mol/l (l: liter) of Ti and at least one metal element selected from Co, Fe, Ni, V, Cu, Mn, and Zn, the total molar ratio of the at least one metal element being 0.01 to 10 relative to Ti.

3. The method for producing a surface-treated steel sheet according to claim 2, wherein the Ti content of the adhesive film is 3 to 200 mg/m$^2$ per surface of the steel sheet.

4. A method for producing a surface-treated steel sheet, the method comprising forming a corrosion-resistant film that includes at least one layer selected from a Ni layer, a Sn layer, an Fe—Ni alloy layer, an Fe—Sn alloy layer, and an Fe—Ni—Sn alloy layer on at least one surface of a steel sheet; and forming an adhesive film by performing a cathode electrolytic treatment using the apparatus for continuous electrolytic treatment of a steel sheet according to claim 1, in an aqueous solution containing 0.008 to 0.07 mol/l (l: liter) of Zr.

5. The method for producing a surface-treated steel sheet according to claim 4, wherein the aqueous solution further contains at least one metal element selected from Co, Fe, Ni, V, Cu, Mn, and Zn, the total molar ratio of the at least one metal element being 0.01 to 10 relative to Zr.

6. The method for producing a surface-treated steel sheet according to claim 4, wherein the aqueous solution further contains at least one substance selected from phosphoric acids and phenolic resins, the total molar ratio of the at least one substance being 0.01 to 10 relative to Zr.

7. The method for producing a surface-treated steel sheet according to claim 4, wherein the Zr content of the adhesive film is 3 to 200 mg/m$^2$ per surface of the steel sheet.

8. The apparatus for continuous electrolytic treatment of a steel sheet according to claim 1, further comprising a treatment bath, the N pairs of tabular electrodes provided within the treatment bath.

9. The method for producing a surface-treated steel sheet according to claim 6, wherein the aqueous solution further contains at least one metal element selected from Co, Fe, Ni, V, Cu, Mn, and Zn, the total molar ratio of the at least one metal element being 0.01 to 10 relative to Zr; and the aqueous solution further contains at least one substance selected from phosphoric acids and phenolic resins, the total molar ratio of the at least one substance being 0.01 to 10 relative to Zr.

* * * * *